US012808281B2

(12) United States Patent
Zhang et al.

(10) Patent No.: US 12,808,281 B2
(45) Date of Patent: Nov. 24, 2026

(54) AUTONOMOUS INFLOW CONTROL DEVICE, METHOD, AND SYSTEM

(71) Applicant: Baker Hughes Oilfield Operations LLC, Houston, TX (US)

(72) Inventors: Zhihui Zhang, Katy, TX (US); Bin Zhu, Houston, TX (US); Guijun Deng, The Woodlands, TX (US); Ronnie Russell, Cypress, TX (US); Daniel C. Ewing, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 20 days.

(21) Appl. No.: 18/895,732

(22) Filed: Sep. 25, 2024

(65) Prior Publication Data

US 2026/0085593 A1 Mar. 26, 2026

(51) Int. Cl.
*E21B 34/08* (2006.01)

(52) U.S. Cl.
CPC ..... *E21B 34/08* (2013.01)

(58) Field of Classification Search
CPC ..... E21B 34/08; E21B 34/085; E21B 34/06; E21B 2200/02; E21B 43/12
See application file for complete search history.

(56) References Cited

U.S. PATENT DOCUMENTS

2011/0186300 A1* 8/2011 Dykstra ..... E21B 43/32 138/40
2011/0198097 A1* 8/2011 Moen ..... E21B 34/08 166/324
2013/0048299 A1* 2/2013 Fripp ..... E21B 43/08 138/40
2015/0060084 A1* 3/2015 Moen ..... E21B 43/08 166/321
2015/0261224 A1* 9/2015 Lopez ..... G05B 15/02 700/282
2016/0053576 A1 2/2016 Fripp et al.
2019/0040714 A1 2/2019 Fripp et al.

OTHER PUBLICATIONS

Notification of Transmittal of the International Search Report and the Written Opinion of the International Searching Authority, or the Declaration; PCT/US2025/047741; Mail date: Jan. 21, 2026; 8 pages.

* cited by examiner

*Primary Examiner* — George S Gray
(74) *Attorney, Agent, or Firm* — Baker Hughes Patent Organization

(57) ABSTRACT

An autonomous inflow control device, including a first flow modifier and a second flow modifier disposed in series with one another, a third flow modifier and a fourth flow modifier disposed in series with one another, a first sensor, a second sensor, a valve responsive to a difference between a signal from the first sensor and a signal from the second sensor. A method for including flowing a fluid to a device, splitting the flow into a first flow path of the device and a second flow path of the device, generating a signal in a first sensor in the first flow path, generating a signal in a second sensor in the second flow path, and opening or closing a valve responsive to a differential in the signal from the first sensor and the signal from the second sensor. A borehole system including the autonomous inflow control device.

21 Claims, 7 Drawing Sheets

AUTONOMOUS INFLOW CONTROL DEVICE, METHOD, AND SYSTEM

BACKGROUND

In the resource recovery and fluid sequestration industries particular fluids that are desired to be conveyed are often mixed with fluids that are not desired to be conveyed. The art has worked to screen out undesired fluids using viscosity based exclusion devices and alternatively density based exclusion devices. Where viscosity of the fluids is close, only the density based exclusion devices are generally used but those too have difficulty where density of the fluid is also relatively close. The art would well receive new technology that enhances conveyance of desired fluids while excluding unwanted fluids.

SUMMARY

An embodiment of an autonomous inflow control device, including a first flow path having a first flow modifier and a second flow modifier disposed in series with one another, a second flow path having third flow modifier and a fourth flow modifier disposed in series with one another, a first sensor in the first flow path between the first flow modifier and the second flow modifier, a second sensor in the second flow path between the third flow modifier and the fourth flow modifier, a valve responsive to a difference between a signal from the first sensor and a signal from the second sensor.

An embodiment of a method for controlling fluid flow to maximize flow of desirable fluid and minimize flow of undesirable fluid, including flowing a source fluid to an autonomous inflow control device, splitting the flow into a first flow path of the device and a second flow path of the device, generating a signal in a first sensor located in the first flow path, generating a signal in a second sensor in the second flow path, and opening or closing a valve responsive to a differential in the signal from the first sensor and the signal from the second sensor.

An embodiment of a borehole system including a borehole in a subsurface formation, a string in the borehole, and an autonomous inflow control device disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
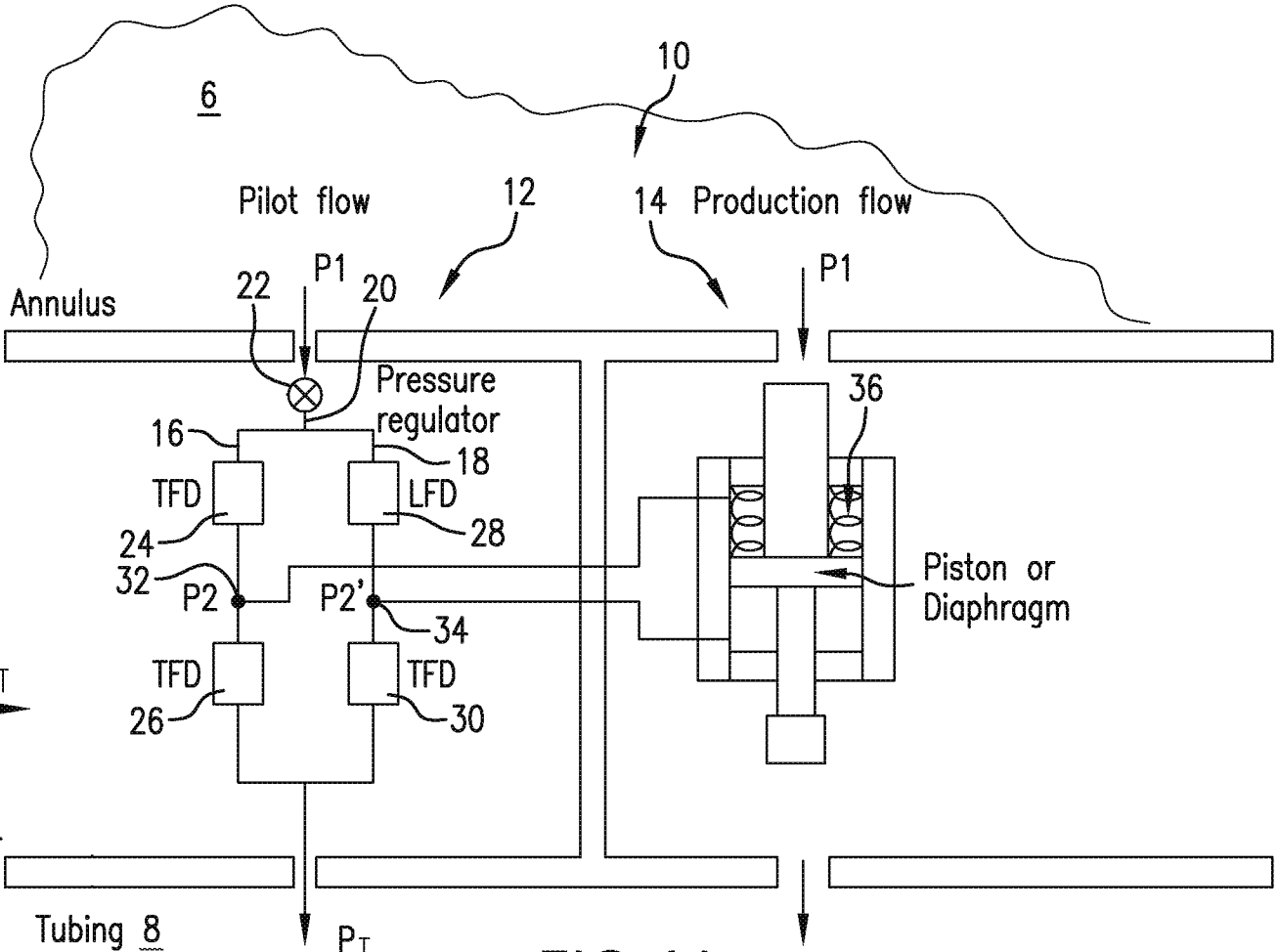
FIG. 1A is a schematic illustration of an autonomous inflow control device as disclosed herein.
Figure 1B:
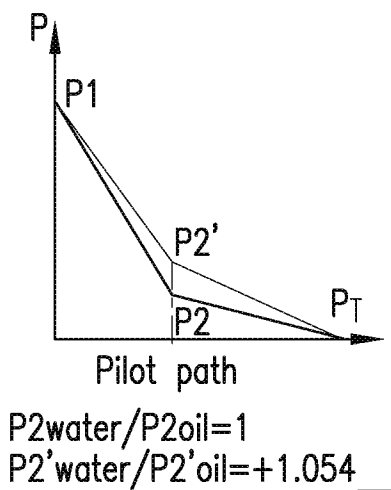
FIG. 1B is a pressure chart related to FIG. 1A.

Referring to FIG. 1A, an autonomous inflow control device 10 is schematically illustrated, with FIG. 1B illustrating a pressure chart to be viewed along with FIG. 1A. It is to be appreciated that both a pilot path and a production path are illustrated on FIG. 1A, which are essentially parallel pathways (not necessarily geometrically speaking). These illustrate fluid flowing from a source 6, such as a reservoir into device 10 and out into an outlet 8 such as a tubing string. The pilot path will have continuous flow to tubing 8 but is small as the term "pilot" is known to be in the art, while the production path may be a larger volume under circumstances that will become clear below. Device 10 includes a discriminator 12 and a valve 14 that operate between the source 6 and the tubing 8. Whether or not the production path is open depends upon what is encountered in the pilot path as further disclosed below. The discriminator 12 comprises a first flow path 16 and a second flow path 18. The flow paths 16 and 18 are split from an inlet 20 and run parallel (philosophically or geometrically parallel in various embodiments). Some embodiments will also have a pressure regulator 22 at the inlet 20. The pressure regulator 22 is desirable when the viscosity of water being produced and the viscosity oil being produced is close ("close" meaning herein that oil viscosity is less than 3 times water viscosity). In light oil production scenarios, this is common. The pressure regulator 22 maintains a constant pressure change (DeltaP) across the flow modifiers 24, 26, 28, and 30 for reliable flow performance across a wider range of total DeltaP (source 6 to tubing 8) across the autonomous inflow control device 1. Use of the pressure regulator 22 defines an operating window of 50-60 pounds per square inch (PSI) where the oil pressure will always be higher than the water pressure. See operating window box on chart below. Outside of the operating window, it is possible for the pressure of water to exceed the pressure of oil. For example, see point A and point B below, which illustrate pressures if the operating window were 70 to 100 PSI instead of 50 to 60 PSI as taught herein. The pressure of the water at point A is higher than the pressure of oil at point B and hence the valve 14 would operate in the opposite direction of what is intended if the device 10 were operated outside of the operating window. With the device operating within the operating window (box below), however, as noted, the oil will always have a higher pressure than the water. It is the pressure regulator 22 that ensures the device 10 will only operate within the operating window. It is to be understood that different operating windows are achievable with correspondingly different results. Some examples are found below.

In a scenario where the viscosity of oil is higher ("higher" in this case meaning greater than 3 times water viscosity) than water, the pressure regulator 22 becomes optional.

Specifically with regard to the discriminator 12, and still referring to FIG. 1A, within each of the first flow path 16 and second flow path 18 are pressure modifiers. In order to avoid confusion, the modifiers are discussed herein as first and second modifiers (first flow path), and third and fourth modifiers (second flow path). The modifiers are consecutively numbered as 24, 26, 28, and 30, respectively. Pressures are labeled in the several drawings as P1 (source pressure), P2 (first flow path pressure), P2' (second flow path pressure, and $P_T$ (tubing pressure). In a first embodiment, and illustrated in FIG. 1A, first modifier 24 and second modifier 26 are both turbulent flow modifiers. Turbulent flow modifiers are to be understood to be devices that create pressure drops using nonlaminar flows, or turbulent flows. One example of a turbulent flow modifier is a hydrocyclone. Other examples include but are not limited to an orifice, venturi nozzle, or a flow channel in which the Reynolds number of the fluid is less than 2300.

TFM 24 and 26 are configured in series with respect to flow and together they create a signal, which may be a pressure signal in some embodiments, at a first sensor 32 between first modifier 24 and second modifier 26. In the second flow path 18, the modifiers 28 and 30 are different from each other, with modifier 28 being a laminar flow modifier. Commonly, tubular coils are employed to facilitate a laminar flow with sufficient length to create a pressure drop. Any laminar flow device that creates a pressure drop may be employed in in the currently disclosed autonomous inflow control device 10. Other examples of laminar flow modifiers include but are not limited to porous materials, tortuous channels or other channels in which the Reynolds of the fluid is greater than 2300. The LFM 28 is required so that a second sensor 34, which also may generate a pressure signal, will be different than the signal generated in first sensor 32. Structurally, the second flow path 18 is otherwise similar to the first flow path 16 in that the sensor 34 is disposed between the third modifier 28 and fourth modifier 30. The two signals, one generated in the first sensor 32 and one generated in the second sensor 34, because they are different, will have a delta between them. That deltaP is conveyed to the valve 14 to drive the valve 14 in one direction or the other to either increase flow area through the valve 14 or decrease flow area through the valve 14. The former is a valued result if the fluid being encountered in the discriminator 12 is desirable and the latter is a valued result if the fluid being encountered in the discriminator 12 is undesirable. As will be appreciated from the schematic view of FIG. 1, the valve 14 may be a piston type valve that is supplied with the signal from sensor 32 on one side of the valve and the signal from sensor 34 on the opposite side of the valve, hence causing the valve to shuttle in the direction away from the larger magnitude signal. The signals from sensor 32 and 34 may also be used to actuate motors, pumps, etc. to actuate the valve 14. Valve 14 is not limited to a piston type valve that is moved only by the deltaP. In some embodiments, a biaser 36 such as a coil spring, may be incorporated into the valve 14 to bias the valve in a direction where pressure drop when one fluid (i.e. either water or oil) is flowing through the LFD and TFD is not equal (e.g having a pressure difference greater than 2 psi) pressure. In other words, if the pressure drop on the LFD and the TED is the same, no biaser is needed but if the pressure drop on the LFD and the TED is different, a biaser might be desirable for use. The valve 14 will automatically move to a more open position or a more closed position depending upon what fluids are encountered in the discriminator 12.

Referring to FIGS. 2A and 2B, one embodiment of the discriminator 12 (same construction as illustrated in FIG. 1) is schematically illustrated along with specific parameters and results. The embodiment uses a single laminar flow modifier while the other three are TFMs. In this embodiment, modifiers 24, 26 and 30 are TFMs and modifier 28 is an LFM.

Still referring to FIGS. 2A and 2B, it will be appreciated that the inlet pressure is 50 pounds per square inch (PSI), which is either regulated or inherent in the system in order to maintain the operating window. TFMs 24 and 26 both include a 0.1 inch inside diameter nozzle while LFM 28 includes 101 internal microflow paths of 0.01 inch inside diameter and TFM 30 includes a 0.05 inch inside diameter nozzle. Resultingly, a 1.78 gallon per minute flow of water and a 1.92 gallon per minute flow of oil at the inlet 20 results in a delta P signal from the sensors 32 and 34 that plots a graph showing a 1.25 PSI deltaP over an 8 PSI operational window.

Figure 2:
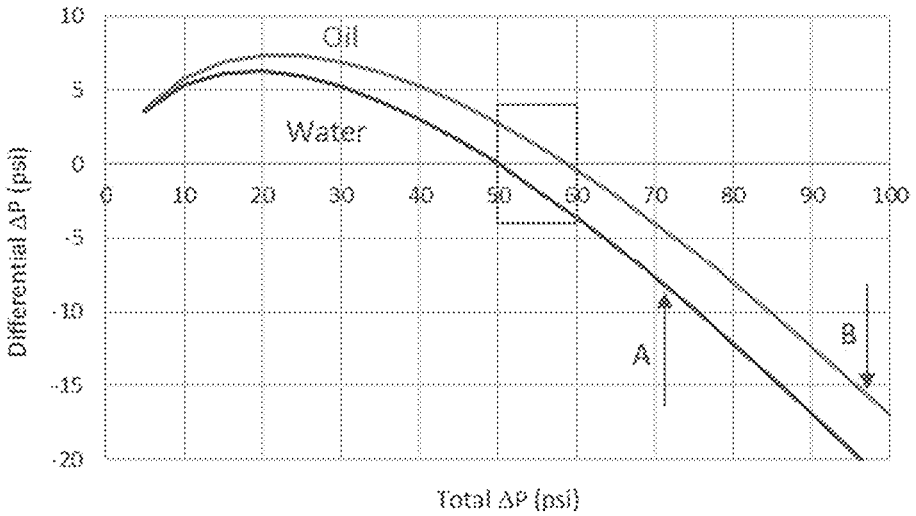
FIGS. 2A and 2B schematically illustrate a DeltaP reversal with a single LFD.
Figures 3A, 3B:
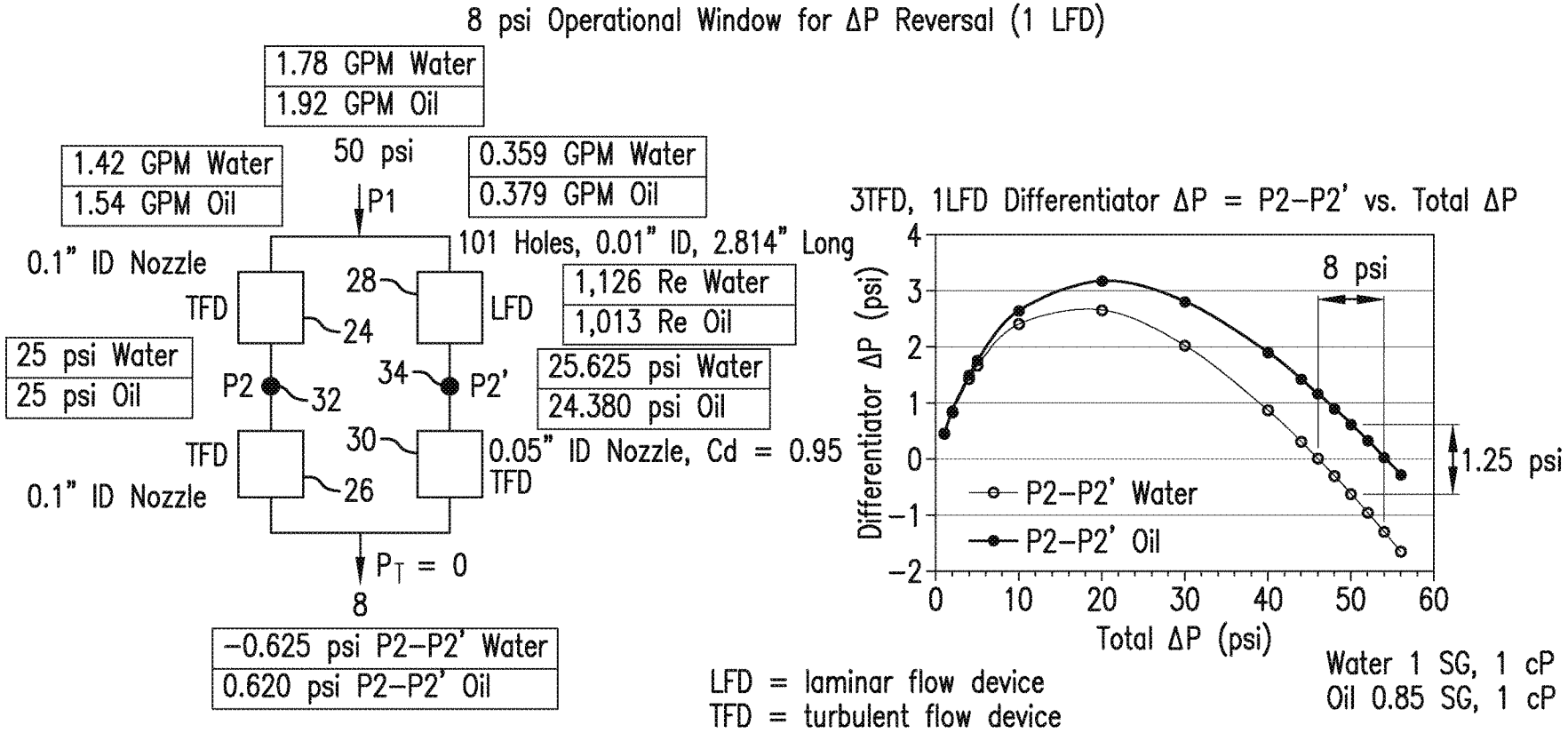
FIGS. 3A and 3B schematically illustrate a DeltaP reversal with two LFDs.

Referring to FIGS. 3A and 3B, a greater deltaP can be obtained at the same inlet pressure (50 PSI) and 8 PSI operational range by changing TFM 26 to an LFM, that has the same properties as LFM 28 in FIG. 2 (and in FIG. 3). The deltaP in signals from sensor 32 and sensor 34 include a sign reversal and hence are in this embodiment 2.5 PSI, double the delta of the embodiment of FIGS. 2A and 2B.

Figure 4A:
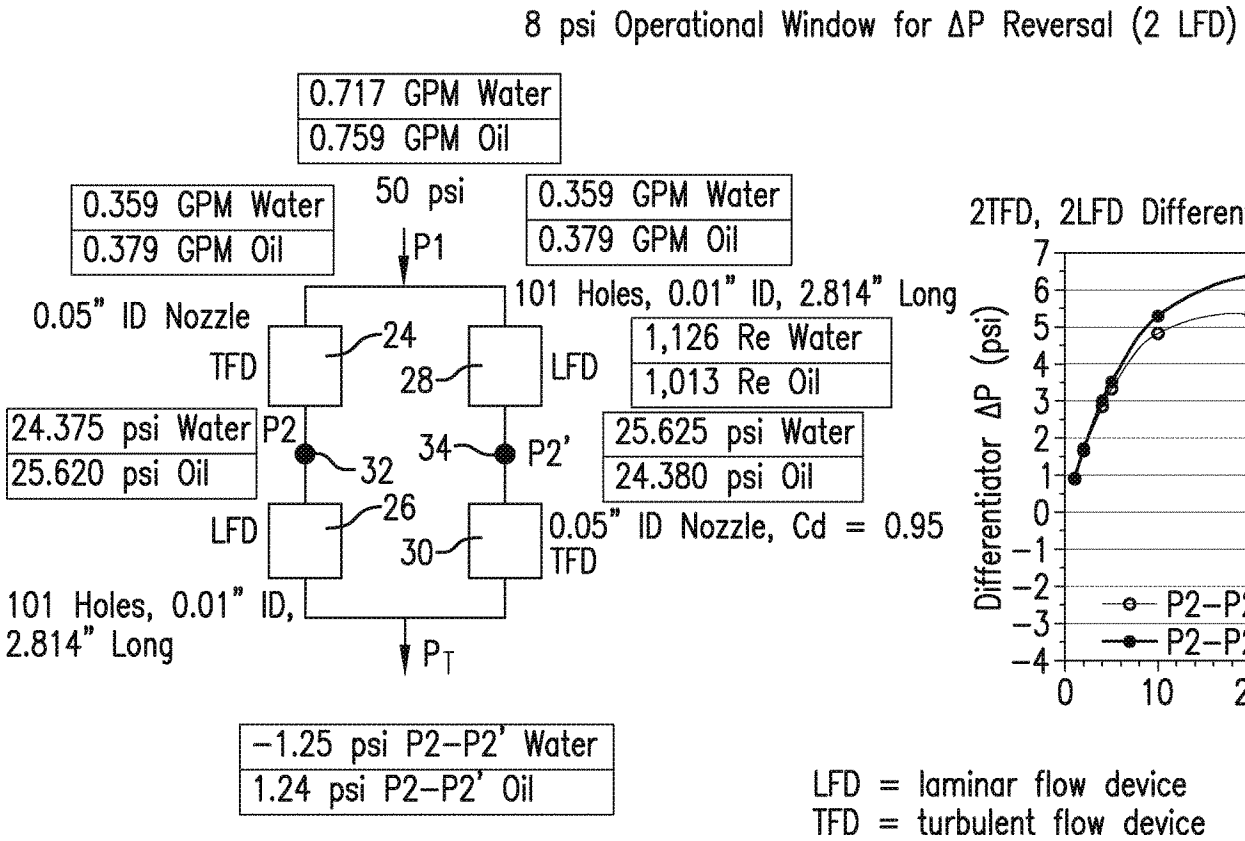
FIGS. 4A and 4B schematically illustrate a DeltaP reversal with two LFDs and a different number of holes for the LFDs.
Figure 4B:
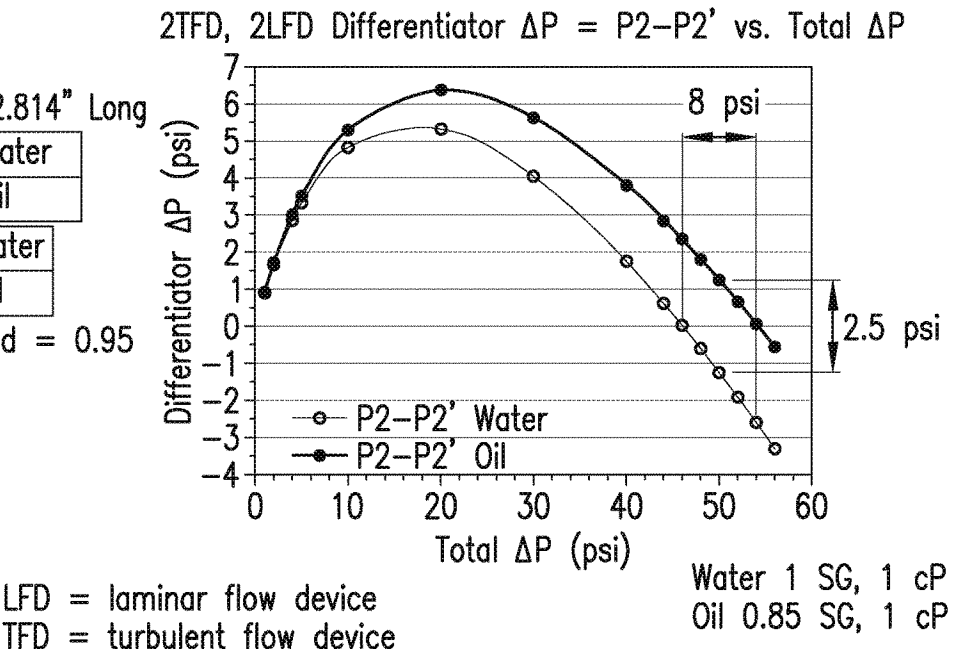

In another alternate embodiment, referring to FIGS. 4A and 4B, a 58 PSI operational window is achievable with a 2.5 PSI delta from sensors 32 and 34 in the same configuration as FIG. 3 but with changes to the properties of the TFMs and LFMs. Specifically, the LFMs 26 and 28 are configured with 180 holes or 0.01 inch ID, while the TFMs 24 and 30 are configured with 0.05 inch ID nozzles. A 50 PSI inlet pressure composed of 0.585 gallon per minute water and 0.609 gallon per minute oil with the discriminator 12 as shown provide the large operating range of 58 PSI while maintaining the 2.5 PSI DeltaP.

Figures 5A, 5B:
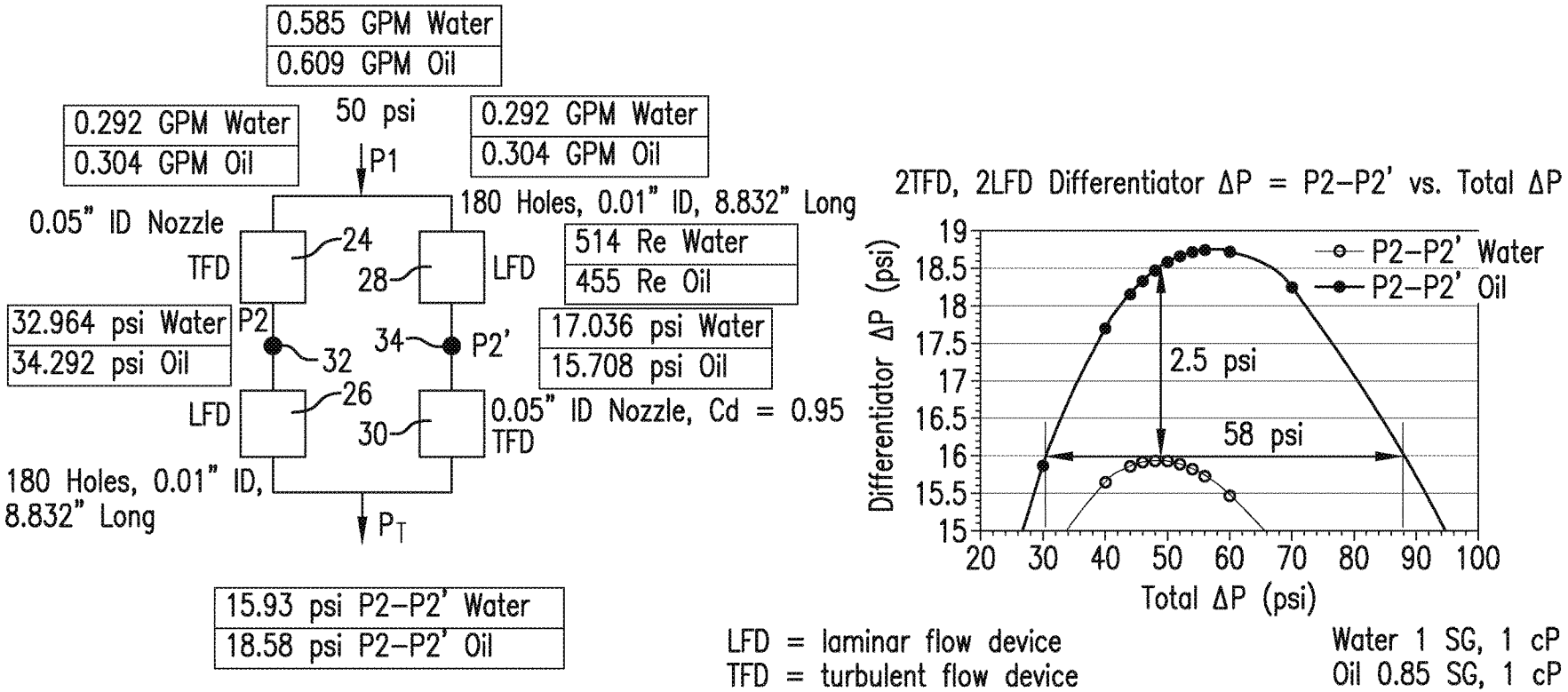
FIGS. 5A and 5B schematically illustrate a DeltaP reversal with two LFDs and the different number of holes for the LFDs as in FIGS. 4A and 4B but at a higher inlet pressure.

In yet another embodiment, referring to FIGS. 5A and 5B, the same structure as FIG. 4A is run at 130 PSI inlet pressure with 1.142 gallons per minute water and 1.205 gallons per minute oil. The results in this case are a 7 PSI Delta P over an operating window of 22 PSI.

It is to be understood that the examples of embodiments are provided for purposes of illustration and not limitation. Other adjustments to structure of the TFMs and LFMs as well as changes to the inlet pressure and content of source fluid will yield additional results that may be better than those in the specific examples.

Figures 6A, 6B:
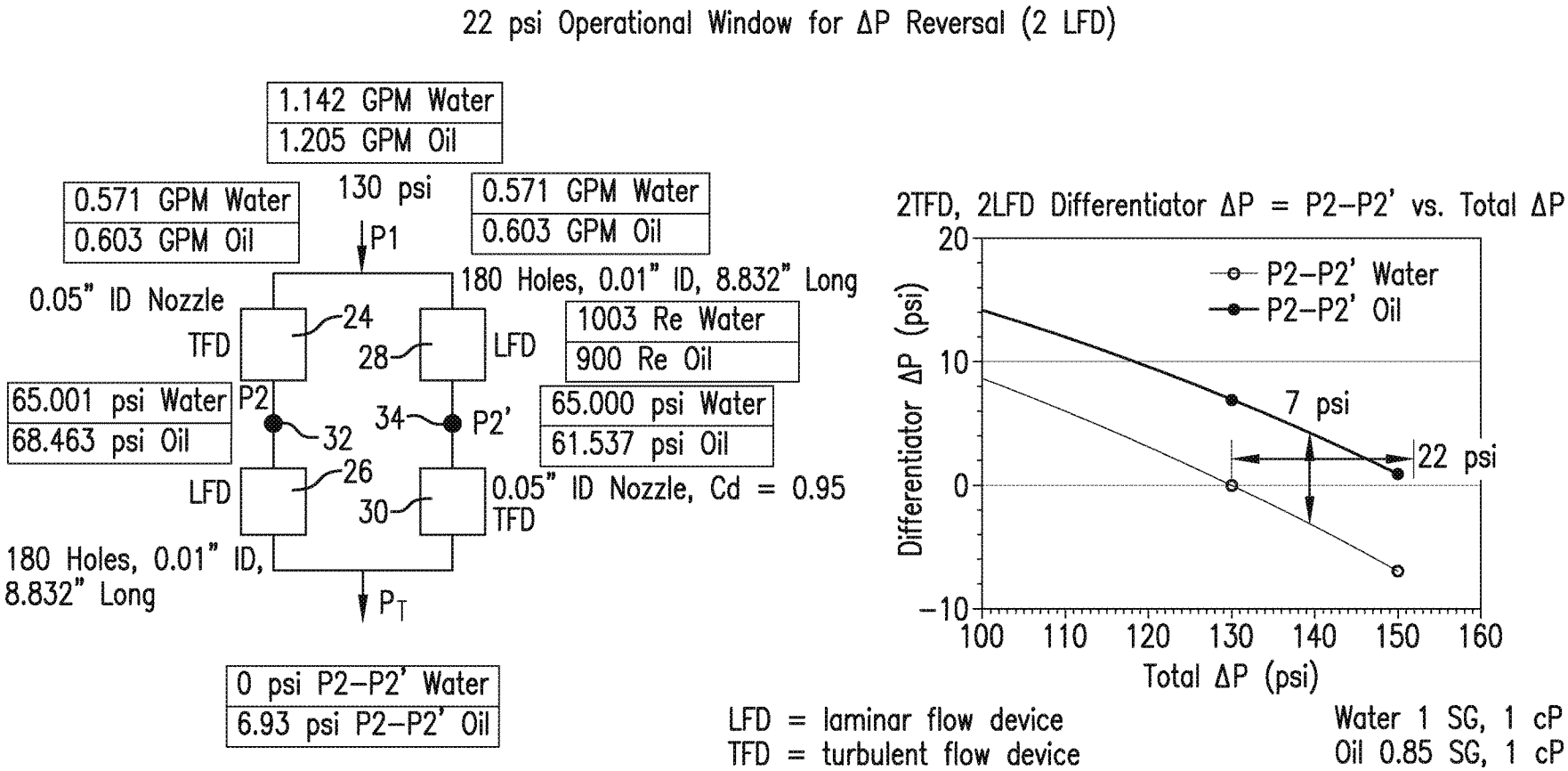
FIG. 6 is a view of a borehole system including the autonomous inflow control device as disclosed herein.
Figure 7:
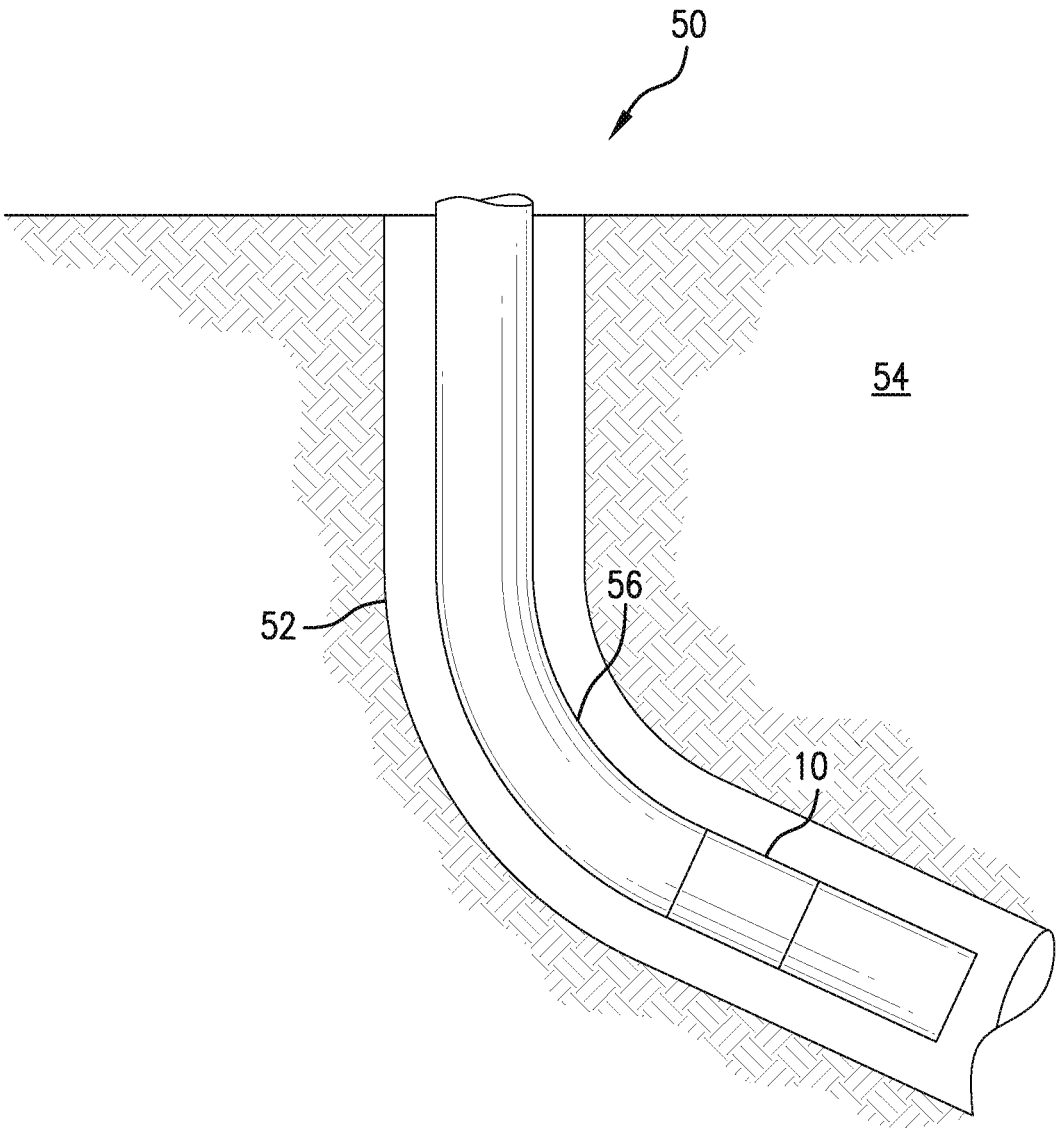

Referring to FIG. 6, a borehole system 50 is illustrated. The system 50 comprises a borehole 52 in a subsurface formation 54. A string 56 is disposed within the borehole 52. An autonomous inflow control device 10 as disclosed herein is disposed within or as a part of the string 56.

Set forth below are some embodiments of the foregoing disclosure:

Embodiment 1: An autonomous inflow control device, including a first flow path having a first flow modifier and a second flow modifier disposed in series with one another, a second flow path having third flow modifier and a fourth flow modifier disposed in series with one another, a first sensor in the first flow path between the first flow modifier and the second flow modifier, a second sensor in the second flow path between the third flow modifier and the fourth flow modifier, a valve responsive to a difference between a signal from the first sensor and a signal from the second sensor.

Embodiment 2: The device as in any prior embodiment, wherein the first and second modifiers in the first flow path are selected from a laminar flow modifier and a turbulent flow modifier.

Embodiment 3: The device as in any prior embodiment, wherein the first and second modifiers are different than each other.

Embodiment 4: The device as in any prior embodiment, wherein the third and fourth modifiers in the second flow path are selected from a laminar flow modifier and a turbulent flow modifier.

Embodiment 5: The device as in any prior embodiment, wherein the third and fourth modifiers of the second flow path are different than each other.

Embodiment 6: The device as in any prior embodiment, wherein at least one of the first, second third and fourth modifiers is different than the other three.

Embodiment 7: The device as in any prior embodiment, wherein the first and second modifiers are different from each other and positioned in a first order in the first flow path and wherein the third and fourth modifiers are the same modifiers as the first and second modifiers but positioned, in the second flow path, in a reversed order to that of the first and second modifiers in the first flow path.

Embodiment 8: The device as in any prior embodiment, wherein in the first flow path the turbulent flow modifier is positioned upstream of the laminar flow modifier.

Embodiment 9: The device as in any prior embodiment, wherein the valve is a piston valve.

Embodiment 10: The device as in any prior embodiment, wherein at least one of the first sensor and second sensor is a pressure sensor.

Embodiment 11: The device as in any prior embodiment, further including a pressure regulator configured to regulate pressure entering one or more of the first and second flow paths.

Embodiment 12: A method for controlling fluid flow to maximize flow of desirable fluid and minimize flow of undesirable fluid, including flowing a source fluid to an autonomous inflow control device, splitting the flow into a first flow path of the device and a second flow path of the device, generating a signal in a first sensor located in the first flow path, generating a signal in a second sensor in the second flow path, and opening or closing a valve responsive to a differential in the signal from the first sensor and the signal from the second sensor.

Embodiment 13: The method as in any prior embodiment, wherein the generating a signal in each of the first and second sensors is measuring a pressure.

Embodiment 14: The method as in any prior embodiment, wherein the opening or closing the valve is variable in response to a change in pressure measured in the first sensor and the second sensor.

Embodiment 15: The method as in any prior embodiment, wherein the flowing in the first flow path includes flowing through a first fluid modifier and then through a second fluid modifier.

Embodiment 16: The method as in any prior embodiment, wherein the generating the signal from the first sensor occurs between the flowing through the first fluid modifier and the second fluid modifier.

Embodiment 17: The method as in any prior embodiment, wherein the flowing in the second flow path includes flowing through a third fluid modifier and then through a fourth fluid modifier.

Embodiment 18: The method as in any prior embodiment, wherein the generating the signal from the second sensor occurs between the flowing through the third fluid modifier and the fourth fluid modifier.

Embodiment 19: The method as in any prior embodiment, wherein the first flow modifier, second flow modifier, third flow modifier, and fourth flow modifier, comprise at least one laminar flow modifier among the four flow modifiers.

Embodiment 20: The method as in any prior embodiment, further including regulating pressure of fluid entering the autonomous inflow control device.

Embodiment 21: The method as in any prior embodiment, further including maintaining through pressure regulation operation of the autonomous inflow control device in an operating window there a desirable fluid is always at a higher pressure than a nondesirable fluid.

Embodiment 22: A borehole system including a borehole in a subsurface formation, a string in the borehole, and an autonomous inflow control device as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An autonomous inflow control device, comprising:

a pilot flow comprising:

a pressure regulator that regulates incoming flow pressure in the pilot flow;

a first flow path having a first flow modifier and a second flow modifier disposed in series with one another;

a second flow path having third flow modifier and a fourth flow modifier disposed in series with one another;

a first sensor in the first flow path between the first flow modifier and the second flow modifier;

a second sensor in the second flow path between the third flow modifier and the fourth flow modifier;

a production flow, separate from the pilot flow, comprising:

a valve responsive to a difference between a signal from the first sensor and a signal from the second sensor.

2. The device as claimed in claim 1, wherein the first and second modifiers in the first flow path are selected from a laminar flow modifier and a turbulent flow modifier.

3. The device as claimed in claim 2, wherein the first and second modifiers are different than each other.

4. The device as claimed in claim 2, wherein in the first flow path the turbulent flow modifier is positioned upstream of the laminar flow modifier.

5. The device as claimed in claim 1, wherein the third and fourth modifiers in the second flow path are selected from a laminar flow modifier and a turbulent flow modifier.

6. The device as claimed in claim 5, wherein the third and fourth modifiers of the second flow path are different than each other.

7. The device as claimed in claim 1, wherein at least one of the first, second, third, and fourth modifiers is different than the other three.

8. The device as claimed in claim 1, wherein the first and second modifiers are different from each other and positioned in a first order in the first flow path and wherein the third and fourth modifiers are the same modifiers as the first and second modifiers but positioned, in the second flow path, in a reversed order to that of the first and second modifiers in the first flow path.

9. The device as claimed in claim 1, wherein the valve is a piston valve.

10. The device as claimed in claim 1, wherein at least one of the first sensor and second sensor is a pressure sensor.

11. The device as claimed in claim 1, further including a pressure regulator configured to regulate pressure entering one or more of the first and second flow paths.

12. A borehole system comprising:

a borehole in a subsurface formation;

a string in the borehole; and an autonomous inflow control device as claimed in claim 1 disposed within or as a part of the string.

13. A method for controlling fluid flow to maximize flow of desirable fluid and minimize flow of undesirable fluid, comprising:

flowing a source fluid to an autonomous inflow control device in a pilot flow and a separate production flow;

regulating pressure in the pilot flow;

splitting the pilot flow into a first flow path of the device and a second flow path of the device;

generating a signal in a first sensor located in the first flow path;

generating a signal in a second sensor in the second flow path; and opening or closing a valve in the production flow responsive to a differential in the signal from the first sensor and the signal from the second sensor.

14. The method as claimed in claim 13, wherein the generating a signal in each of the first and second sensors is measuring a pressure.

15. The method as claimed in claim 13, wherein the opening or closing the valve is variable in response to a change in pressure measured in the first sensor and the second sensor.

16. The method as claimed in claim 13, wherein the flowing in the first flow path includes flowing through a first flow modifier and then through a second flow modifier.

17. The method as claimed in claim 16, wherein the generating the signal from the first sensor occurs between the flowing through the first flow modifier and the second flow modifier.

18. The method as claimed in claim 16, wherein the flowing in the second flow path includes flowing through a third flow modifier and then through a fourth flow modifier.

19. The method as claimed in claim 18, wherein the generating the signal from the second sensor occurs between the flowing through the third flow modifier and the fourth flow modifier.

20. The method as claimed in claim 18, wherein the first flow modifier, second flow modifier, third flow modifier, and fourth flow modifier, comprise at least one laminar flow modifier among the four flow modifiers.

21. A method for controlling fluid flow to maximize flow of desirable fluid and minimize flow of undesirable fluid, comprising:

flowing a source fluid to an autonomous inflow control device;

splitting the flow into a first flow path of the device and a second flow path of the device;

generating a signal in a first sensor located in the first flow path;

generating a signal in a second sensor in the second flow path; and opening or closing a valve responsive to a differential in the signal from the first sensor and the signal from the second sensor; and further including maintaining through pressure regulation of fluid entering the autonomous inflow control device operation of the autonomous inflow control device in an operating window where a desirable fluid is always at a higher pressure than a nondesirable fluid, while fluid is flowing through the autonomous inflow control device.

* * * * *